United States Patent [19]

Pries

[11] 4,093,519

[45] June 6, 1978

[54] DECARBONIZING APPARATUS FOR AN UNDERJET-TYPE OF COKE OVEN BATTERY

[75] Inventor: Erich Pries, Bochum, Germany

[73] Assignee: Dr. C. Otto & Comp. G.m.b.H., Bochum, Germany

[21] Appl. No.: 602,766

[22] Filed: Aug. 7, 1975

[30] Foreign Application Priority Data

Aug. 19, 1974 Germany ..... 2439724

[51] Int. Cl.[2] ..... C10B 43/12; C10B 21/12

[52] U.S. Cl. ..... 202/241; 202/142; 202/141; 202/151; 431/32; 431/2; 208/48 R

[58] Field of Search ..... 202/241, 142, 141, 151; 431/32, 2, 354; 208/48 R; 137/604, 597

[56] References Cited

U.S. PATENT DOCUMENTS

| | | | |
|---|---|---|---|
| Re. 15,992 | 2/1925 | Wilputte | 202/241 |
| 1,097,196 | 5/1914 | Sperr, Jr. | 202/241 |
| 2,302,728 | 11/1942 | Wethly | 202/241 X |
| 2,623,846 | 12/1952 | Robert | 202/142 |
| 2,789,086 | 4/1957 | Schurhoff et al. | 202/142 |

*Primary Examiner*—James H. Tayman, Jr.
*Attorney, Agent, or Firm*—Thomas H. Murray

[57] ABSTRACT

In the cellar located below an underjet-type of battery of coke ovens are gas distribution pipes. A gas dispensing nozzle is located within each of the separate pipes which extend from a distribution pipe through the regenerators into the burners for a row of heating flues between two coking chambers. These nozzles are cleaned by injecting compressed air from a pipeline that extends parallel to the rich gas distribution pipe. A nipple opposite each nozzle interconnects the air pipeline and the gas pipe. The nipple receives a plug having either an orifice or a nozzle tube to direct compressed air toward the gas dispensing nozzle. A supply header for compressed air extends along the battery of coke ovens and this header is connected by a valve to each compressed air pipeline in the cellar. A controller responsive to a timer operates the valves during regenerative heating reversals for periodic cleaning of the gas dispensing nozzles with compressed air.

7 Claims, 5 Drawing Figures

DECARBONIZING APPARATUS FOR AN UNDERJET-TYPE OF COKE OVEN BATTERY

BACKGROUND OF THE INVENTION

This invention relates to an underjet-type and regeneratively-operated battery of coke ovens, and more particularly to a pipeline system for the periodic dispensing of compressed air toward gas dispensing nozzles located within the relatively cool part of distribution pipes for rich gas within a cellar below such a battery of coke ovens.

The regenerators for an underjet-type of battery of coke ovens have vertical passageways extending through the walls of the regenerators and from which burners extend into the heating flues. A row of these heating flues extends between adjacent coke oven chambers for supplying heat thereto by the combustion of rich gas in the same regenerative half-cycle or portion thereof. For this purpose, the burners in the heating flues are connected to rich gas distribution lines which extend parallel to the row of heating flues from a cellar located below the regenerators. The quantity of gas supplied to each burner is accurately dispensed by a nozzle located in a readily accessible portion or a branch line connected in the cellar to the distribution line for rich gas. Each nozzle, in addition to being readily accessible, is located in the cellar where the gas conducting lines are relatively cool.

As is known, the aforementioned nozzles function as control elements and they are replaceable in the gas lines. Each nozzle has a gas conducting opening which is considerably decreased as to its size in relation to the gas conducting space in the pipeline. Most gases conducted by such a pipeline system for combustion in the heating flues contain ingredients which have a marked tendency to condense or separate out at normal ambient temperatures. The nozzles are particularly susceptible to an accumulation of condensed or separated ingredients of the rich gas. The nozzles, therefore, must be cleaned periodically because even a partial clogging of the nozzles may drastically impair the correct distribution of gases to the various burners in the heating flues.

To clean these nozzles in the past, it has been necessary to open the gas line by removing a closure-like cover and then either the nozzle must be removed for cleaning and replacement, or the nozzle is left in place and a cleaning tool is inserted into the nozzle. This method of cleaning the nozzles has the acute disadvantage of requiring the opening of the gas line. Moreover, considerable labor costs are incurred to periodically clean all the nozzles for a battery of coke ovens where there are a large number of burners and a nozzle associated with each such burner.

To alleviate the manual cleaning process, it has been proposed to arrange a facility opposite each nozzle for blowing compressed air or some other inert gas toward the nozzle. The facility is arranged substantially along the nozzle axis and opens toward the nozzle. After an associated distribution line is turned ON to feed gas through the line, the facility is operated briefly to clean the nozzle. An example of such a nozzle cleaning facility is disclosed in West German Pat. No. 1,601,284. While this prior art form of cleaning facility has advantages, the present invention is addressed to an improved system for cleaning the nozzles in branch lines from gas feed lines extending from a cellar into the heating flues for a battery of coke oven chambers.

SUMMARY OF THE INVENTION

It is an object of the present invention to provide an improved system for supplying compressed air for cleaning nozzles in rich gas distribution lines within a cellar below regenerators for heating flues of a battery of coke ovens.

It is a further object of the present invention to provide an improved system for supplying compressed air for cleaning gas dispensing nozzles without requiring their removal from rich gas distribution lines wherein the system includes a pipeline for compressed air in the cellar extending in a parallel relation to each feed line for rich gas which is coupled by branch lines to the burners within a row of heating flues and wherein the system further includes a header for compressed air extending along the battery of coke ovens for distributing controlled quantities of compressed air through the use of valves controlled by a regenerative reversal control timer or a different timer in synchronism therewith.

More particularly, the present invention is addressed to an underjet-type of regeneratively-heated battery of coke ovens which includes a cellar extending below the regenerators, gas distribution pipes in the cellar which include a rich gas feed pipe extending from a distribution pipe for conducting rich gas through a regenerator to each discrete burner in a row of heating flues between coking chambers, and a gas dispensing nozzle located within the relatively cool part of the pipes in the cellar to control the supply of rich gas to each burner, the improvement including the combination of a pipeline for conducting compressed air in the cellar below each row of heating flues in a manner such that each pipeline extends in a generally parallel relation to a gas distribution pipe for rich gas in the cellar and communicating with the aforesaid nozzles, means for injecting compressed air at spaced-apart locations from the pipeline therefor into the adjacent gas distribution pipe and at a spaced-apart location from the gas dispensing nozzles for periodic cleaning thereof, a supply header to conduct compressed air along the battery of coke ovens to each pipeline for compressed air, valve means for controlling the flow of compressed air in each pipeline, and control means including a timer to operate the valve means for periodic cleaning of the gas dispensing nozzles by the controlled discharge of compressed air.

In such a system, the pipeline serving to supply compressed air to the means for injecting the compressed air toward the nozzles preferably takes the form of tubes interconnecting the interiors of nipples received in orifices at spaced-apart locations along the rich gas distribution line. The orifices in these lines are opposite to gas dispensing nozzles at branch lines. The projecting ends of the nipples are closed by plugs. Each plug may include a tube extending in a direction toward a nozzle for discharging compressed air adjacent the nozzle. Alternatively, the plug may be provided with an end plate formed with a central opening facing toward the interior of the rich gas distribution line to direct compressed air toward the nozzle. In the system of the present invention as above described and more fully disclosed hereinafter, compressed air may be discharged at intervals of time as required by the extent to which foreign materials accumulate on and around the openings in the gas discharge nozzles. For example, there can be an ON period for the discharge of compressed air in every regenerative half-cycle. Another mode of operation is to turn ON the compressed air for cleaning the nozzles for a period of time at intervals of hours and days. Feeding compressed air to the various distribution lines along the battery of coke ovens in a consecutive manner will save compressed air. In this respect, the supply of compressed air to clean the nozzles can be sufficient to supply one or more air distribution lines instead of requiring the use of a compressed air supply capable of furnishing sufficient quantities of compressed air to all the air distribution lines at one time.

These features and advantages of the present invention as well as others will be more readily understood from the following description when read in light with the accompanying drawings, in which.

Figure 1:
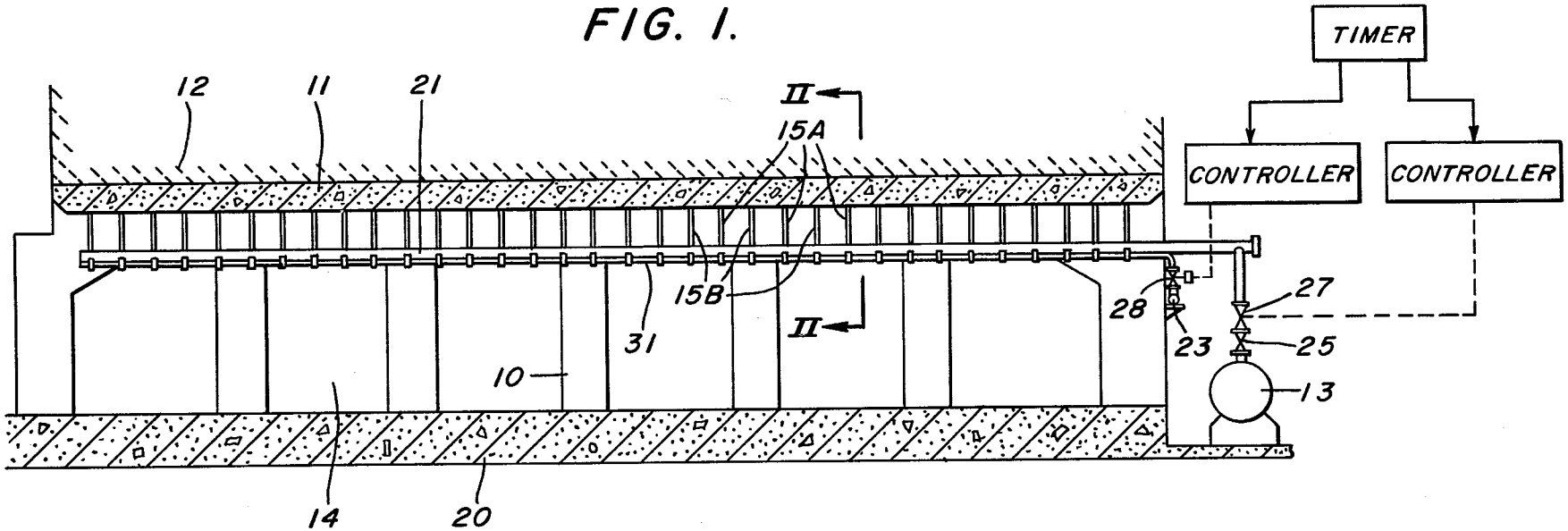
FIG. 1 is an elevational view, in section, of the cellar below one coke oven chamber of a battery of coke ovens of the underjet type.
Figure 3:
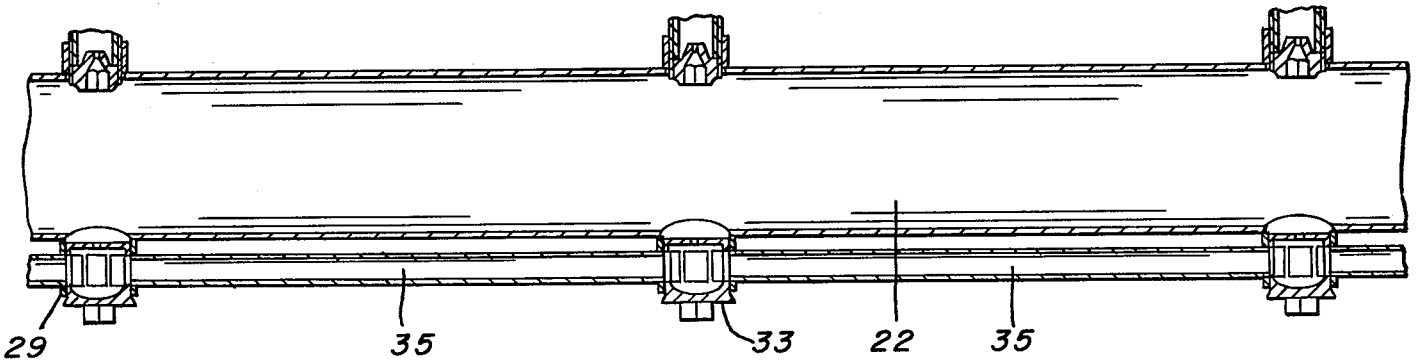
FIG. 3 is a sectional view taken along line III—III of FIG. 2.

In FIG. 1, there is illustrated a cellar 14 arranged below an underjet-type of battery of coke ovens. Support pillars 10 extend from a base slab 20 and support a concrete crown or ceiling 11 for the battery of coke ovens. Oven masonry 12 is disposed above the ceiling 11. Extending along one side of the battery of coke oven chambers is a rich gas distribution line or main 13. Connected to this main are various rich gas feed lines, two of which are identified by reference numerals 21 and 22. These feed lines are sometimes referred to as nozzle tubes. Stop valves 25 and reversal valves 27 embodied as three-way valves, control the flow of rich gas from the main to the feed lines 21 and 22. As shown in FIG. 1, the valves 27 are controlled by a controller that responds to a signal from a timer. This timer provides signals to control the regenerative heating half-cycles of each heating wall in the battery of coke ovens. As is well known in an underjet-type of coke oven battery, some of the burners in a heating flue receive a supply of rich gas from line 21 during one half-cycle and other burners receive gas from line 22 in the other half-cycle. A compressed air distribution header 23 extends parallel to the gas conducting main 13. Pipelines 31 and 32 are connected by reversal valves 28 to the header 23. The valves 28 are each controlled by a controller which, in turn, responds to a signal from the aforementioned timer. The valves 28 are preferably turned ON separately for a relatively short period of time to carry out cleaning of gas discharge nozzles with compressed air. Pipelines 31 and 32 extend parallel to the lines 21 and 22 to supply compressed air to blow tubes as more fully described hereinafter.

Figure 2:
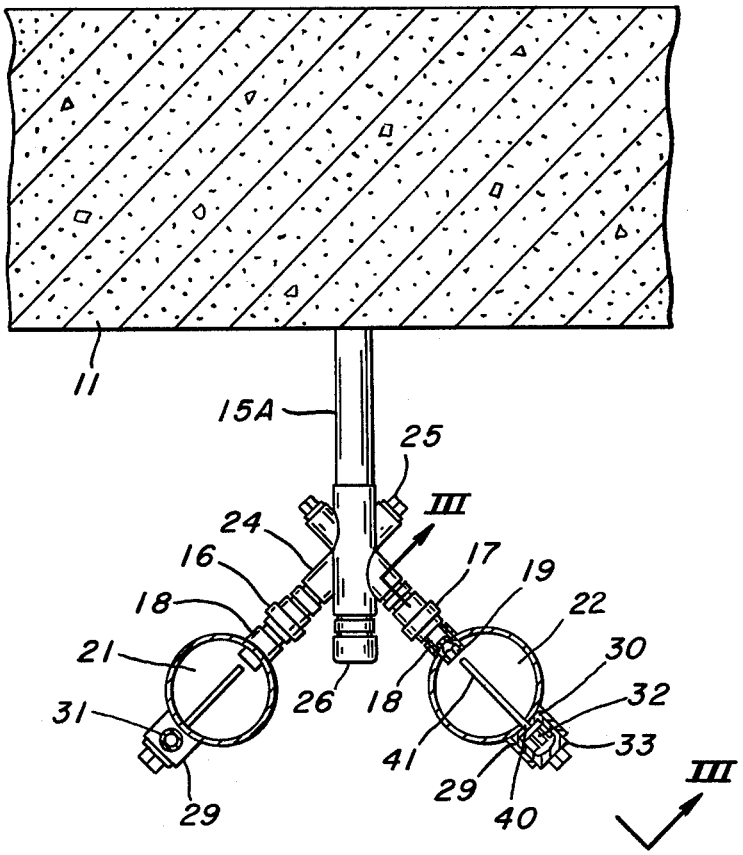
FIG. 2 is a sectional view taken along line II—II of FIG. 1.

The rich gas feed lines 21 and 22, as clearly shown in FIGS. 1 and 2, supply gas to vertical pipes 15A and 15B, respectively, for one row of heating flues. Each vertical pipe 15A is connected to feed line 22 by a branch pipe 24 and a threaded connector 17, such as a threaded union, which extends in an upwardly-inclined direction from the feed line 22. A similar threaded connector 16 and a branch pipe 24 interconnect each vertical tube 16B and pipeline 21. The vertical pipes 15A and 15B extend through vertical passageways in the regenerator walls which project into the heating flues. Line 21 supplies rich gas to the burners which operate during one half-cycle while line 22 supplies gas to the burners in the heating wall which operate during the other half-cycle. Typically, these burners open out of the sole of each flue forming part of a twin-flue heating system that extends between adjacent coking chambers.

Figure 4:
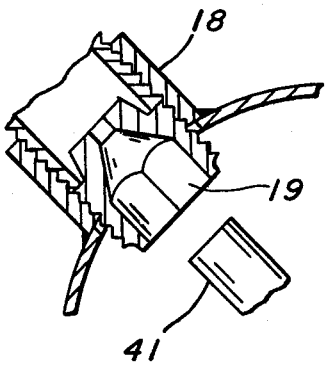
FIG. 4 is an enlarged sectional view of a gas dispensing nozzle to undergo cleaning according to the present invention.

Removable plugs 26 close the bottom ends of lines 15A and 15B so that a pocket or the like is provided for collecting falling dust in these lines. Each plug 26 is removable for removing the dust. An upper extension to each branch pipe 24 is formed with an orifice which is closed by a plug 25 and by removing the plug, access is gained to the interior of the threaded connector 16 or 17. A nipple 18 with internal threads interconnects each connector 16 with line 21 and each connector 17 with line 22. A gas dispensing nozzle 19 has external screw threads for mating engagement with internal screw threads in the nipple 18 as is clearly shown in FIG. 4.

Figure 5:
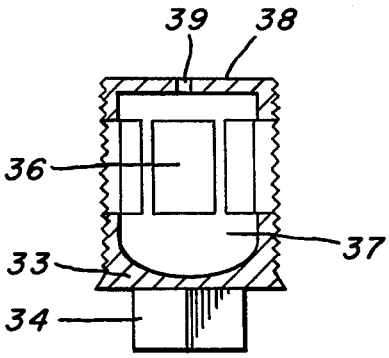
FIG. 5 is an enlarged sectional view of a plug forming part of the present invention.

The nozzle 19 is replaceable through the orifice-like opening located opposite the nozzle. This orifice-like opening is formed in the wall of the gas distribution pipe 21. Surrounding the opening in a manner to form an external extension thereof, is a nipple 29 having internal screw threads 30. FIG. 5 illustrates a plug 33 with external screw threads that mate with the internal screw threads of nipple 29. The plug includes a squared end 34 by which the plug is engaged with a spanner, key, wrench or the like to remove and replace the plug in the nipple.

The opposite ends of the plug are interconnected by a ring of thin webs which forms therebetween orifice openings 36 along the plug. In this way, when the plug is positioned within the nipple 29, compressed air passes through the orifice openings 36. The internal space 37 of each plug 33 is closed by a plate or dish member 38 having a nozzle-like orifice 39 formed therein for injecting compressed air toward a nozzle 19 to be cleaned. As shown in FIG. 2, the nozzle-like orifice 39 is extended by a member 40 used to retain a blow tube 41 for injecting compressed air at a closely-spaced location from the nozzle 19.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a battery of underjet coke ovens which includes regenerative heating by regenerators above a cellar, gas distribution pipes in the cellar including rich gas feed pipes extending from each distribution pipe through regenerators having a high temperature environment to conduct rich gas to burners within a row of heating flues between two coking chambers, a gas dispensing nozzle located within the relatively cool part of the pipes in the cellar below the regenerators for supplying rich gas to each burner, the improvement in a decarbonizing apparatus including:

a pipeline in said cellar for conducting compressed air below each row of heating flues, each pipeline extending in a generally parallel relation to a gas distribution pipe supplying rich gas to said nozzles, means below the high temperature environment of said regenerators coupled between each gas dispensing nozzle for rich gas to inject compressed air from said pipeline into the gas distribution pipe toward the opening in a gas dispensing nozzle located below the regenerators within said relatively cool part of said distribution pipe for periodic cleaning of the gas dispensing nozzle, a supply header for conducting compressed air along the battery of coke ovens for each said pipeline, valve means for controlling the flow of compressed air from said supply header to each said pipeline, a regenerative reversal control timer for reversing regenerative heating of the underjet coke ovens, controller means responsive to a control signal from said timer to control regenerative heating reversals in the heating walls of the coke oven battery, and control means coupled to operate said valve means in response to a signal from said regenerative reversal control timer for periodic cleaning of said gas dispensing nozzles.

2. The combination according to claim 1 wherein, for each gas dispensing nozzle in a gas distribution pipe, said means to inject compressed air include a nipple surrounding an orifice in a wall of the gas distribution pipe, said nipple projecting from the gas distribution pipe at a location opposite to a gas dispensing nozzle, and a plug for closing the projected end of said nipple.

3. The combination according to claim 2 wherein said pipeline for conducting compressed air includes tubes interconnecting the interiors of said nipples projecting from a gas distribution pipe for each row of heating flues.

4. The combination according to claim 3 further including a blow tube supported by said plug for directing compressed air toward a gas dispensing nozzle.

5. The combination according to claim 2 wherein said plug includes an end plate with a central opening for directing compressed air toward a gas dispensing nozzle.

6. The combination according to claim 2 wherein said plug includes a threaded side wall having apertures therein for the flow of compressed air therethrough, and said nipple includes threads for mating engagement with the threaded side wall of said plug.

7. The combination according to claim 1 further comprising valve means responsive to said controller for controlling the flow of gas in each rich gas feed pipe.

* * * * *